US006530623B1

(12) United States Patent
Kazumura

(10) Patent No.: US 6,530,623 B1
(45) Date of Patent: Mar. 11, 2003

(54) FOAM-FORMING NET FOR FACE-WASHING AND PREPARING METHOD THEREOF

(76) Inventor: Izumi Kazumura, 16-5, Jingumae 6-Chome, Shibuya-ku, Tokyo (JP)

( * ) Notice: Subject to any disclaimer, the term of this patent is extended or adjusted under 35 U.S.C. 154(b) by 0 days.

(21) Appl. No.: 09/566,940

(22) Filed: May 8, 2000

(30) Foreign Application Priority Data

Dec. 5, 1999 (JP) ..... 1999-131502

(51) Int. Cl.[7] ..... A47K 7/02
(52) U.S. Cl. ..... 300/21; 15/209.1; 15/229.11
(58) Field of Search ..... 15/209.1, 229.11; 300/21

(56) References Cited

U.S. PATENT DOCUMENTS 6,092,257 A * 7/2000 Chen
6,131,234 A * 10/2000 Chen

FOREIGN PATENT DOCUMENTS

JP 10276928 10/1998

OTHER PUBLICATIONS

The Nikkei Marketing Journal, Jun. 7, 1997, p. 4.
Dime, Nov. 20, vol. 12, No. 22, p. 100–101.
$H_2O$, Feb. 1998, vol. 7, No. 5, p. 153.
Suteki–na Okusan, Apr., vol. 9, No. 4, p. 50.
Kireini Naritai, Nov. 1998, vol. 4, No. 11, p. 51.
Genki–ga Deru Karada–no Hon, vol. 3, (Orange Page Mook), p. 39.

* cited by examiner

*Primary Examiner*—Randall E. Chin
(74) *Attorney, Agent, or Firm*—Birch, Stewart, Kolasch & Birch, LLP

(57) ABSTRACT

A foam-forming net for face washing is herein disclosed which is able to a allow a face washing toiletry such as liquid soap, solid soap and the like to foam finely and silkily when using the face washing toiletry for removing makeup or face-washing. A cylindrical plastic net of 200–300 mm in width having at least one diamond-shaped mesh, one side of which is approximately one millimeter which is cut into a length of 150–250 mm. Opposite air layers are formed by thermowelding one end of the net. A thermowelded part of the net in the vicinity of the edge is pushed inside and the net is turned out. Net layers are formed upward and downward of the air layers. A top portion of the gathered and bound part is pushed inside and a finger-inserting ring is attached to an upper end of the top portion.

13 Claims, 4 Drawing Sheets

FOAM-FORMING NET FOR FACE-WASHING AND PREPARING METHOD THEREOF

BACKGROUND OF THE INVENTION

1. Field of the Invention

This invention relates to a foam-forming net for face-washing which can allow a facial washing toiletry such as liquid soap, solid soap and the like to foam finely and silkily when removing makeup or washing a face with the facial washing toiletry. This invention also relates to a method of preparing the foam-forming net for face-washing.

2. Description of the Prior Art

A various kinds of soaps and facial washing toiletries have been developed for removing a makeup such as foundation cream, rouge and the like. However, they are directly applied on a skin without allowing them to foam in particular, then the skin is rubbed with hands to make them interact with dirt, thereafter they are washed away with water together with the dirt.

However, an application of these facial washing toiletries of high concentration directly on the skin stimulates strongly the skin, causing rough skin. Therefore, in the directions of the facial washing toiletries is given a CAUTION: If an abnormality is observed on the skin, please stop using and have a consultation with a dermatologist. And the development of a facial washing toiletry kind to the skin or an auxiliary makeup tool has been desired. The present inventor has developed a foam-forming net for face-washing as an auxiliary makeup tool kind to the skin by which face-washing may be carried out efficiently even when using a small amount of the facial washing toiletry and which can allow the facial washing toiletry to foam finely and silkily (JP-A-10-276928 ("JP-A" means Japanese Laid-Open Patent Publication (Kokai))), which has been further improved to accomplish this invention allowing the facial washing toiletry to foam more silkily and more efficiently.

That is to say, it has been verified that foam adsorbs dirt particles more strongly than a solution as it is, thereby increasing detergency and that more fine foam has more extremely effect. The fundamentals essential to make the skin clean and beautiful are to keep the metabolism of the skin itself normal. By removing dirt contained in the bottom of a pore such as makeup, sebum, dust in the air and the like, the metabolism of a cell is activated and aged keratin layers are peeling off and consequently a moist and beautiful skin may be revive. This is a normal cycle of the skin.

The fundamentals of face-washing are to remove dirt without stimulation or load on the skin. Accordingly, when a user makes use of the facial washing toiletry of strong detergency only for reason that he does not care as long as dirt may be removed, there is the risk of removing substances essential to the skin.

SUMMARY OF THE INVENTION

An object of this invention is to provide an auxiliary makeup tool for face-washing allowing a facial washing toiletry to foam more finely and more efficiently which can enter all parts of pores, thereby removing dirt efficiently, even if the facial washing toiletry is of weak stimulation to a skin.

The above-described object may be attained by forming opposite air layers which are formed by getting both ends of a thermowelded part of one end of a cylindrical plastic net having an appropriate width and length and having at least one diamond-shaped mesh one side of which is an approximately one millimeter butted against each other in a state that an edge of the net is parted right and left at a mid-part of the thermowelded part, a thermowelded part of an area in the vicinity of the edge is pushed inside and the net is turned inside out, net layers formed upward and downward to the air layers, and a substantially hemispherical net layer formed via a finger-inserting ring or cap which is attached in a state that the other end of the cylindrical plastic net is put together and bound to fix, a top of a bound part is turned inside and the finger-inserting ring or cap is attached to an upper end of the top to provide two layers leading partially outside in a mid-part of the net to increase an contact ratio with air and a contact ratio of the net itself to form more silky foam more efficiently.

Further, the above-described object may be attained by a method of preparing a foam-forming net for face-washing characterized in that both ends of a thermowelded part of one end of a cylindrical plastic net having an appropriate width and length and having at least one diamond-shaped mesh one side of which is an approximately one millimeter are got butted against each other in a state that an edge of the net is parted right and left at a mid-part of the thermowelded part, a thermowelded part of an area in the vicinity of the edge is pushed inside and then the other end of the cylindrical plastic net is put together and bound to fix, a top of a bound part is turned inside or outside, to upper end of which is attached a finger-inserting ring or cap.

When using the foam-forming net for face-washing of this invention, a finger of one hand is inserted into the ring attached to the upper end of the net, which is then soaked in water or warm water, to which a proper amount of a facial washing toiletry is applied, the bottom of the net is supported lightly by the other hand, the net is crumpled, spread or rubbed in palms to rub walls between small meshes of the net each other and water, air and the facial washing which are present in the meshes are extremely efficiently intermingled to form silky, soft and fine foam for an extremely short range of time. Since the foam-forming net for face-washing of this invention is provided with two layers of shelf-like net layer part formed in the mid-part of the net yet formed via an air layer between them, more fine and silk-like foam may be formed. The silk-like soft foam may be easily collected by squeezing the net by a hand a finger of which is not inserted into the ring.

The foam-forming net for face-washing in which a colored sponge chip is confined of this invention is colorful and has not only the decorative effect but also the moisture controlling effect because of having water retention characteristics.

Since a finger may be inserted into the ring attached to one end of the net, the net may be extremely easily spread or shrunk and the ring may be extremely conveniently used to dry the net by hanging the ring on a hook.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

Figure 3:
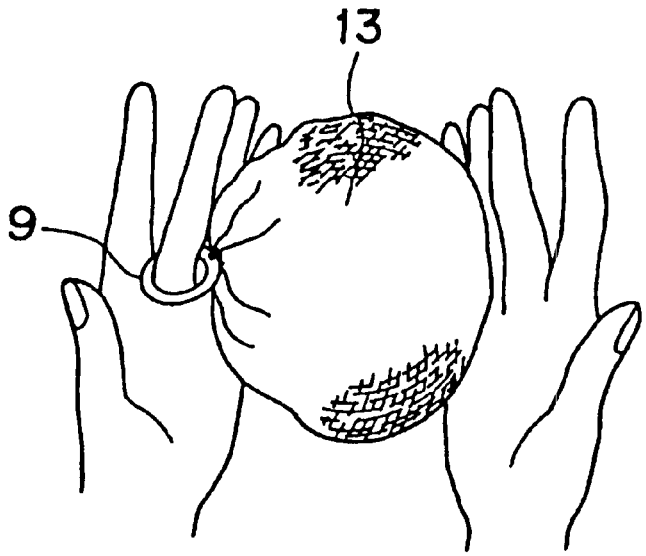
Figure 4:
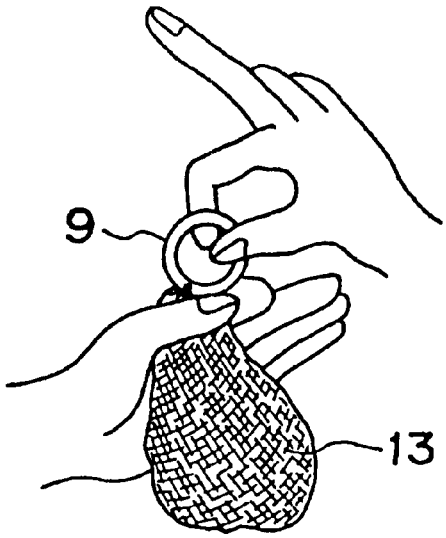
Figure 5:
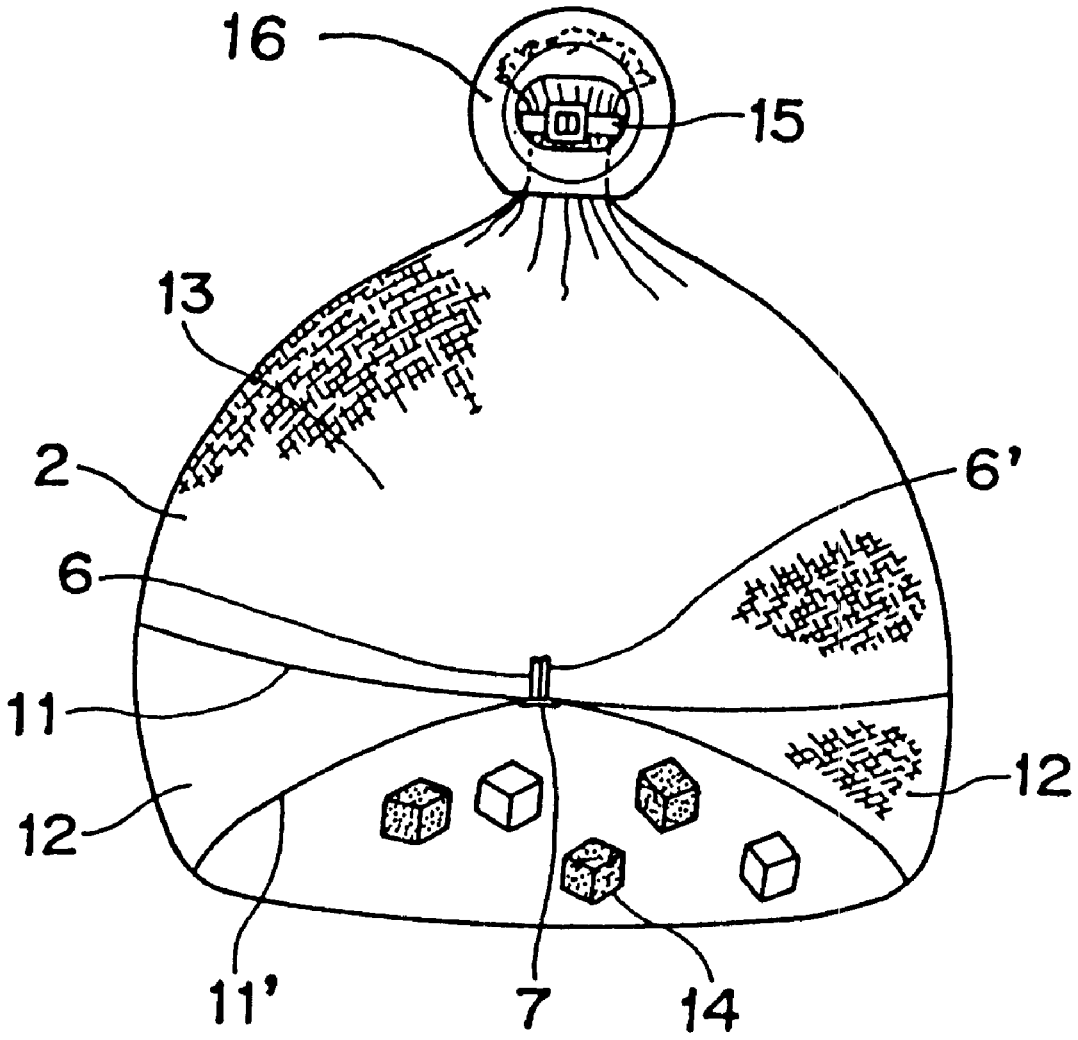

(a) is a schematic view of an integrally molded cylindrical plastic net one end of which is thermowelded;

(b) is a schematic view showing the state that a middle part of the integrally molded cylindrical plastic net one end of which is thermowelded is spread right and left;

(c) is a front view showing the state that an edge part is parted right and left;

(d) is a front view showing the state that an area in the vicinity of the upper edge is thermowelded;

(e) is a front view showing the state that a thermowelded part is pushed inside and the entire net is turned inside out;

(f) is a front view showing the state that a top is pushed inside and a finger-inserting ring is attached thereto;

FIG. 3 is an illustrative view of showing the state that the foam-forming net for face-washing is attached to a hand;

FIG. 4 is an illustrative view of showing the state when foam is collected in hands; and FIG. 5 is a front view of the foam-forming net for face-washing.

DETAILED DESCRIPTION OF THE PREFERRED EMBODIMENTS

Examples of this invention are described in more detail on the basis of figures. A net used in this invention is a cylindrical plastic net of 200–300 mm in width 13 having at least one diamond-shaped mesh 1 one side of which is an approximately one millimeter which is cut into a length of 150–250 mm. Opposite air layers 12 are formed by thermowelding 3 one end of the net and getting both ends 6, 6' of a thermowelded part of the one end of the net in a state an edge 4 of the net is parted right and left at a mid-part 5 of the thermowelded part, and a thermowelded part 7 of an area in the vicinity of the edge is pushed inside and the net is turned inside out. Reference numerals 11 and 11' designate net layers formed upward and downward to the air layers 12. Reference numeral 9 designates a finger-inserting ring formed in a state that the other end 8 of the net 13 is put together and bound to fix, a top of a bound part is pushed inside and a finger-inserting ring is attached to an upper end of the top. Yet, the finger-inserting ring 9 may be attached to an opposite position (bottom) 9 into which a finger may be inserted.

Figure 1:
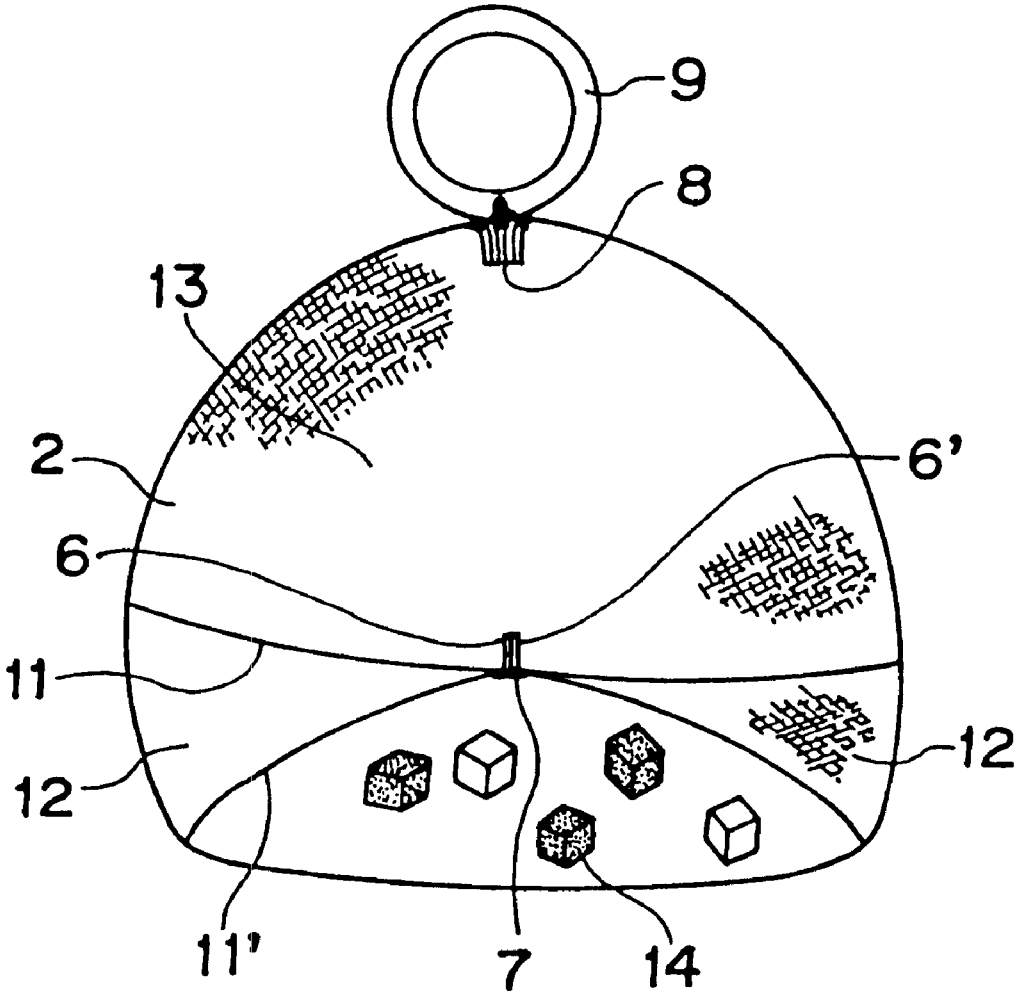
FIG. 1 is a front view of a foam-forming net for face-washing.
Figure 2A:
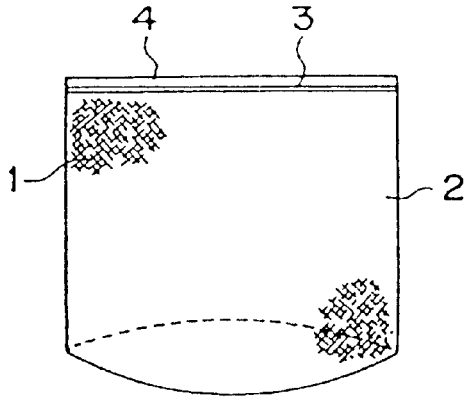
FIG. 2 is an illustrative view of showing the processes of producing the foam-forming net for face-washing.
Figure 2D:
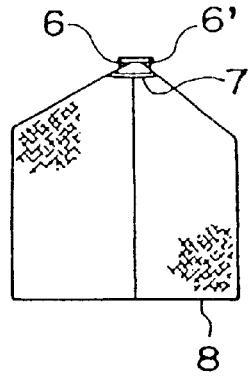
Figure 2B:
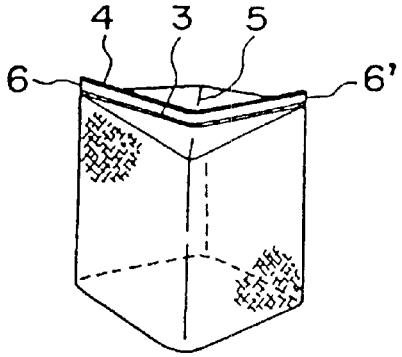
Figure 2E:
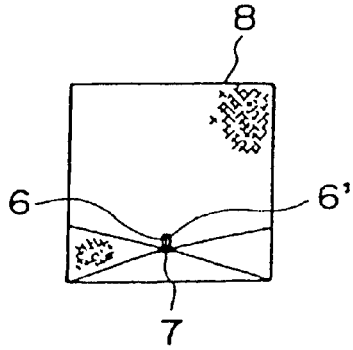
Figure 2C:
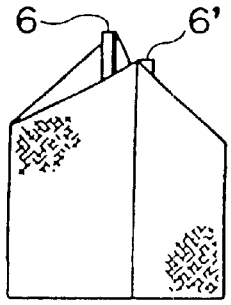
Figure 2F:
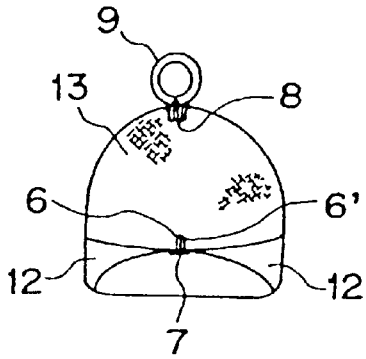

Reference numeral 14 in FIG. 1 designates a colored sponge cut into a small chip of desired shape such as dice and the like, and the proper number of the sponge colored in one to several color may be confined in the net to exhibit colorful decorative effect and water retention characteristics.

In another example shown in FIG. 5, the other end 8 of the net 13 is fastened with a fastening band 15, and a top of a fastened part is turned upward to be bound, to an upper end of which a cap 16 is attached. However, detailed description thereon is omitted because the rest of members and constructions and action and effect are the same as those in the above-described example.

As described above, since the foam-forming net for face-washing of this invention makes use of an integrally molded cylindrical plastic net having at least one fine meshes and air in a small mesh may be extremely efficiently intermingled with water and a detergent to form more silky foam of superior detergent effect extremely easily because the contact area of the net itself can be extremely increased when crumpling, spreading or rubbing the net when using. And, since both ends of the edge 4 of the thermowelded part 3 of the net 13 are got butted against each other in a state that the edge 4 is parted right and left, and are thermowelded, the edge 4 itself is not superimposed, thereby increasing the contact area of the net 13 to intermingle water with a detergent more effectively and to allow the detergent to foam extremely effectively.

Further, since the net of this invention uses as a raw material an integrally molded cylindrical plastic net the raw material of which is synthetic resin such as polyethylene and the like, it may be easily dried and sanitary and may be dried by hanging the finger-inserting ring on a hook and so on. Since the finger-inserting ring is fixed to a top of the net, spreading or shrinking the net by inserting a finger may be extremely easily carried out.

In addition, since the finger-inserting ring is attached in a state that the upper end of the net is turned inside, the net is sure to spread radially from the part to which the ring is attached when hands are about to be joined together, and air in the meshes of the net is intermingled with a detergent when the hands have been joined together and excessive air may be discharged outside, and then when the hands begin to open laterally at a next step, air enters again the meshes of the net which is intermingled with water or the detergent. Since the shape of the mesh of the net is extremely small, fine and creamy foam may be easily formed only by repeating such steps as described above several times.

Even if the facial washing toiletry is harmful when being in contact directly with a skin, a contact area with the skin is extremely small when the facial washing toiletry is converted to fine and creamy foam to dissolve its adverse effect, and simultaneously, the more fine the foam is, the more strong the adsorbability for dirt particles is, thereby increasing detergency, and not only aged horny layer, dust, dirt on the surface of a skin, but also makeup, sebum, dust in air contained in the bottom of a pore may be efficiently washed off because it enters the bottom of the pore.

In addition to that, the foam-forming net for face-washing of this invention in which a colored small chip is confined is colorful and has a decorative effect as well as water retention characteristics for exhibiting moisture controlling.

While preferred embodiments of the invention have been described with a certain degree of particularity with reference to the drawings, obvious modifications and variations are possible in light of the above teachings. It is therefore to be understood that within the scope of appended claims, the invention may be practiced otherwise than as specifically described.

What is claimed is:

1. A foam-forming device for face-washing comprising:

a cylindrical plastic net having at least one diamond-shaped mesh, a pair of ends along a width of the plastic net, and a length;

a finger-inserting ring, said finger-inserting ring securing a top end of said pair of ends of the plastic net;

a thermowelded portion having a pair of thermowelded ends and a mid-portion therebetween, said thermowelded portion securing said thermowelded ends together along said width of the plastic net;

a pair of opposite air layers, said pair of opposite air layers being formed by said thermowelded ends being abutted against each other in a state that an edge of the net is parted right and left at said mid-portion of the thermowelded portion;

a plurality of net layers formed upwardly and downwardly with respect to said opposite air layers, said net layers being formed by inverting said net inside out along the edge of the net parted at said mid-portion; and a substantially hemispherical net layer being formed by gathering said second end of said net together to form a bound portion, said finger-inserting ring securing said bound portion.

2. The foam-forming device according to claim 1, said at least one-side of said diamond-shaped mesh being one millimeter in length.

3. The foam-forming device according to claim 2, said width of said net being 200–300 mm.

4. The foam-forming device according to claim 3, said length of said net being 150–250 mm.

5. The foam-forming device according to claim 1, said width of said net being 200–300 mm.

6. The foam-forming device according to claim 1, said length of said net being 150–250 mm.

7. The foam-forming device according to claim 1, further comprising a plurality of colored sponges, said colored sponges including at least one sponge cut into a relatively smaller chip and being contained within said net layer.

8. The foam-forming device according to claim 7, said small chip being shaped as a die.

9. A method of preparing a foam-forming net for face washing comprising the steps of:

thermowelding a thermowelded portion along a first end of a pair of ends of a cylindrical plastic net, said cylindrical plastic net having at least one diamond-shaped mesh, a width and a length;

abutting a first and a second end of said thermowelded portion together;

parting said net into right and left portions along said abutted thermowelded portion, wherein said parting step includes pulling a top edge of the net along said first end apart at a mid-portion of the thermowelded portion;

thermowelding said first and said second ends of the thermowelded portion into a second thermowelded portion;

inverting said net inside-out, said second thermowelded portion being turned inside-out to invert said net; and binding a second end of said pair of ends of said net with a finger-inserting ring to form a hemispherical net.

10. The method according to claim 9, further comprising the step of arranging a plurality of colored sponges of desired shapes within the net prior to the step of binding the second end of said net.

11. The foam-forming device according to claim 9, said thermowelding step including said net having at least one-side of said diamond-shaped mesh being one millimeter in length.

12. The foam-forming device according to claim 9, said thermowelding step including said width being 200–300 mm.

13. The foam-forming device according to claim 9, said thermowelding step including said length being 150–250 mm.

* * * * *